US007278398B2

(12) United States Patent
Magel

(10) Patent No.: US 7,278,398 B2
(45) Date of Patent: Oct. 9, 2007

(54) CONTROL VALVE FOR A FUEL INJECTOR THAT CONTAINS A PRESSURE INTENSIFIER

(75) Inventor: Hans-Christoph Magel, Pfullingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/566,753

(22) PCT Filed: Jun. 22, 2004

(86) PCT No.: PCT/DE2004/001300

§ 371 (c)(1),
(2), (4) Date: Feb. 1, 2006

(87) PCT Pub. No.: WO2005/015001

PCT Pub. Date: Feb. 17, 2005

(65) Prior Publication Data

US 2006/0196474 A1 Sep. 7, 2006

(30) Foreign Application Priority Data

Aug. 1, 2003 (DE) ..... 103 35 340

(51) Int. Cl.
*F02M 37/04* (2006.01)

(52) U.S. Cl. ..... 123/446; 123/467

(58) Field of Classification Search ..... 123/446, 123/456, 447, 467; 239/88–96
See application file for complete search history.

(56) References Cited

U.S. PATENT DOCUMENTS 4,440,132 A * 4/1984 Terada et al. ..... 123/446
4,448,168 A * 5/1984 Komada et al. ..... 123/446
4,459,959 A * 7/1984 Terada et al. ..... 123/446
5,722,373 A * 3/1998 Paul et al. ..... 123/446
5,852,997 A 12/1998 Vanderpoel
6,805,101 B2 10/2004 Magel
2002/0109014 A1 8/2002 Augustin
2004/0231645 A1* 11/2004 Magel ..... 123/446
2005/0172935 A1* 8/2005 Magel et al. ..... 123/446
2006/0005815 A1* 1/2006 Magel et al. ..... 123/446

FOREIGN PATENT DOCUMENTS

DE 102 18 635 A1 11/2002
EP 0 879 954 A2 11/1998

* cited by examiner

*Primary Examiner*—Carl S. Miller
(74) *Attorney, Agent, or Firm*—Ronald E. Greigg

(57) ABSTRACT

A servo valve for actuating a pressure booster of a fuel injector, the pressure booster having a work chamber separated by a booster piston from a differential pressure chamber and the pressure change in the differential pressure chamber of the pressure booster is effected via the servo valve, via switching valve. The control chamber of the servo valve can both be made to communicate with a high-pressure source and pressure-relieved into a low-pressure-side return, and for generating a fast closing motion at the valve piston, a pressure shoulder acting in the closing direction of the valve piston is embodied between the control chamber and the hydraulic chamber, and control edges without a common opening phase are embodied on the valve piston.

12 Claims, 6 Drawing Sheets

CONTROL VALVE FOR A FUEL INJECTOR THAT CONTAINS A PRESSURE INTENSIFIER

CROSS REFERENCE TO RELATED APPLICATIONS

This application is a 35 USC 371 application of PCT/DE 2004/001300 filed on Jun. 22, 2004.

BACKGROUND OF THE INVENTION

1. Field of the Invention

This invention is directed to an improved servo valve of the type employed, for example, for actuating a pressure booster of a fuel injector.

2. Description of the Prior Art

For supplying combustion chambers of self-igniting internal combustion engines with fuel, both pressure-controlled and stroke-controlled injection systems may be employed. As fuel injection systems, not only unit fuel injectors and pump-line-nozzle units but also reservoir injection systems are used. Advantageously, reservoir injection systems (common rails) make it possible to adapt the injection pressure to the load and rpm of the engine. To attain high specific performance and to reduce emissions from the engine, an injection pressure that is as high as possible is generally required.

For the sake of durability, the attainable pressure level in reservoir injection systems in current use is presently limited to about 1600 bar. To further increase the pressure in reservoir injection systems, pressure boosters are employed with them.

German Patent Disclosure DE 101 23 910.6 refers to a fuel injection system with which fuel is delivered to the combustion chambers of a multi-cylinder internal combustion engine. Each of the combustion chambers of the engine are supplied with fuel via respective fuel injectors. The fuel injectors are subjected to a high-pressure source; the fuel injection system of DE 101 23 910.6 moreover includes a pressure booster, which has a movable pressure booster piston that divides a chamber which can be connected to the high-pressure source from a high-pressure chamber that communicates with the fuel injector. The fuel pressure in the high-pressure chamber can be varied by filling a differential pressure chamber of the pressure booster with fuel or emptying this differential pressure chamber of fuel. Triggering the pressure booster via its differential pressure chamber makes it possible to keep the triggering losses in the high-pressure fuel system less in comparison with triggering via a work chamber communicating intermittently with the high-pressure source. Moreover, the high-pressure chamber of the pressure booster can be relieved only down to the pressure level of the high-pressure reservoir, rather than down to the leakage pressure level. Thus on the one hand the hydraulic efficiency can be improved, and on the other a faster pressure buildup to the system pressure level can be accomplished, so that the time intervals between individual injection phases can be shortened considerably.

A pressure booster can be used on each fuel injector in an internal combustion engine, to increase the injection pressure. If the pressure booster is not activated, a fluidic communication exists from the pressure reservoir to the injection nozzle. Such a system may be equipped with two valves with independently activatable actuators, to assure flexible shaping of the injection course. A disadvantage of this version is the relatively high production cost for controlling such a fuel injection system, with two valves and two independently activatable actuators. Because of the high diverted quantities from the differential pressure chamber of the pressure booster, embodying a pressure booster control valve necessitates the use of a servo-hydraulically supported valve. However, this means relatively high production costs. If conversely, slide valves are used in such systems, this offers the advantage of more favorable production costs and reduced vulnerability to tolerances. However, to assure adequate high-pressure tightness, a large overlap of the slide control edges must be assured, which in turn necessitates a long valve stroke of several millimeters on the part of the slide valve. This in turn means that an exact, fast closing motion of a valve piston can be achieved in such an embodiment only with difficulty, since the strong spring forces required to bring about an exact, fast closing motion are not feasible within the installation space inside the injector. In a valve piston embodied as a slide valve, its long stroke requires a large installation space if strong spring forces are to be implemented.

SUMMARY OF THE INVENTION

To assure an exact, fast closing motion of a control valve for a pressure booster, the control valve is embodied as a slide valve with a pressure shoulder. The valve piston of the slide valve proposed according to the invention may be constructed in two parts, so that it does not have a double guide and can be produced relatively simply. Only two guides of different diameter are needed. The dividing point of the two-part valve piston is located in a low-pressure chamber, while conversely both face ends of the valve piston parts are each subjected to high pressure, so that a separation of the valve piston is precluded. Because of the pressure shoulder embodied on the slide valve, the valve is closed via hydraulic forces, so that it is unnecessary to generate a strong spring force. This in turn has the advantage that the valve proposed according to the invention can be accommodated without difficulty in the available installation space in fuel injectors.

Via the pressure shoulder, a hydraulic restoring force can advantageously be generated. In known slide valves with pressure shoulders, there are a plurality of leakage routes, and a major pressure difference between rail pressure (system pressure) and low pressure exists at a plurality of guide portions of a servo valve piston. As a result, long overlapping lengths must be provided for the guide portions in order to keep the amount of leakage within limits; in this version, this means long structural lengths of the servo valve piston.

If a servo valve piston is embodied with only one guide portion, which is subjected to system pressure (rail pressure) in the state of repose of the fuel injector, the leakage can be reduced considerably. This one guide portion has a smaller sealing diameter, since in this portion, no valve pockets for connecting control bores have to be provided. Production can furthermore be facilitated because the total length of the guide portion of the servo piston is shorter.

As an alternative to embodying the control valve as a 3/2-way slide valve with only one guide portion, which in the state of repose of the fuel injector is subjected to rail pressure, an additional valve seat can be employed to further reduce leakage losses. This additional valve seat may be embodied as a flat seat, and it is structurally simple to provide inside a two-part valve housing, which is also favorable in terms of production costs. Moreover, if a 3/2-way slide valve with a flat seat is used as a control valve for the pressure booster, the efficiency of a fuel injector can be increased considerably. The requisite guide lengths and the valve stroke can be reduced further, which overall contributes to reducing the space required for the proposed 3/2-way slide valve. This assures that the embodiment of the present invention will be used in the target installation space of modern internal combustion engines, where only little installation space is available. Embodying the servo valve as a 3/2-way slide-slide valve with a flat seat makes it possible to achieve a leakage-free servo piston, with which furthermore a predeterminable switching sequence upon valve closure can be realized, to make a post injection at an elevated pressure level possible.

For all the variants of the servo valve proposed according to the invention, two control edges are used for controlling the pressure booster. The control edges (slide seal) are embodied such that upon closure, a time delay between closure of the one and opening of the other of the control edges occurs and is exploited for building up a pressure cushion.

BRIEF DESCRIPTION OF THE DRAWINGS

The invention will now be described in further detail herein below, in conjunction with the drawings, in which.

DESCRIPTION OF THE PREFERRED EMBODIMENTS

Figure 1:
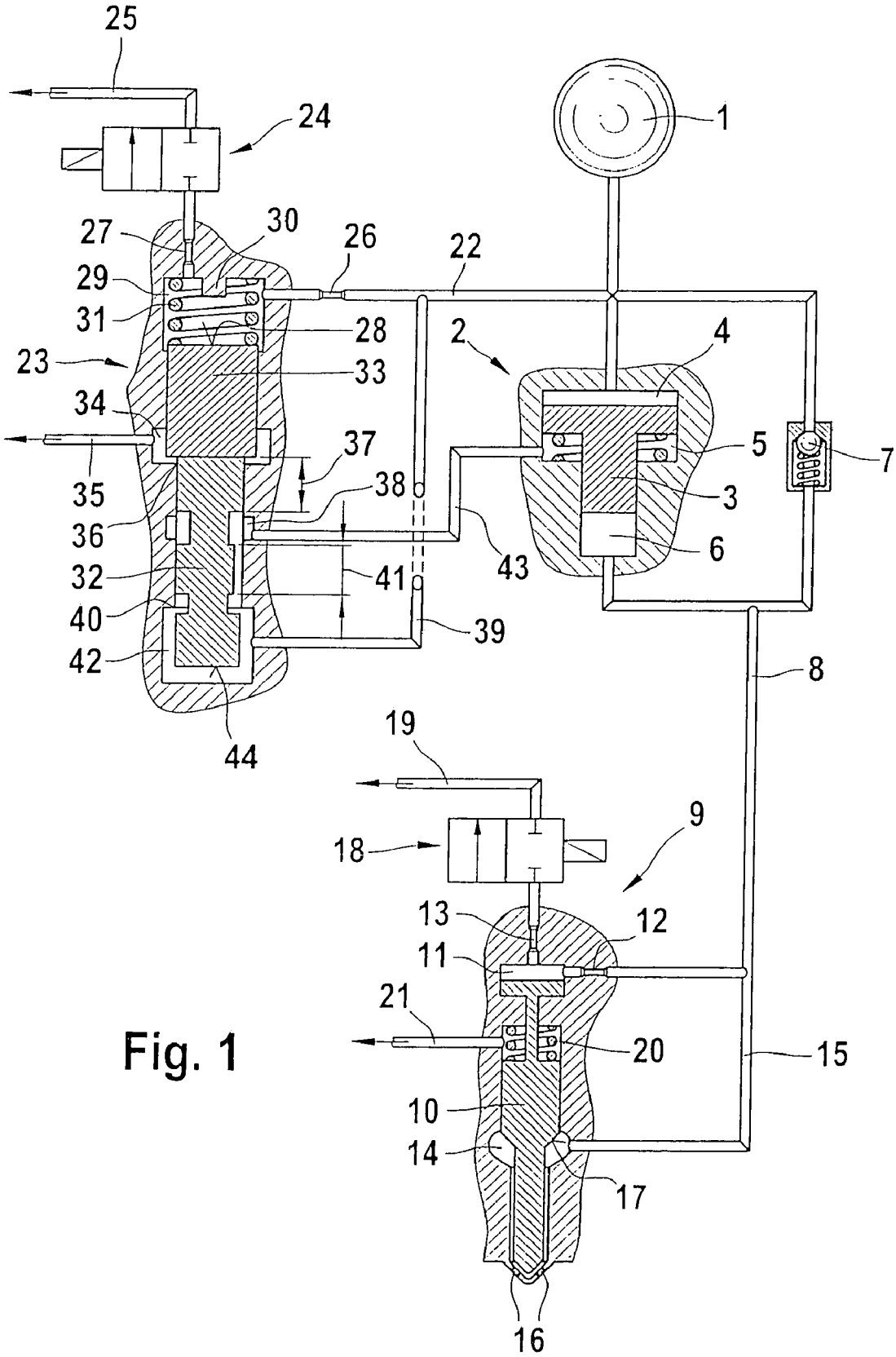
FIG. 1 is a schematic view, in section, of a first embodiment of a servo valve with a pressure shoulder, for triggering a pressure booster of a fuel injector.

FIG. 1 shows a servo valve, embodied as a slide valve, for triggering a pressure booster of a fuel injector. Via a high-pressure source 1, which may be either a high-pressure collection chamber (common rail) or a high-pressure fuel pump, a pressure booster 2 is acted upon by fuel that is at high pressure. The pressure booster 2 includes both a work chamber 4 and a differential pressure chamber 5, which are separated from one another by a booster piston 3. The pressure booster 2 furthermore includes a compression chamber 6 from which a high-pressure line 8 branches off. A check valve 7 is received in the refilling branch of the pressure booster 2.

Via the high-pressure line 8, a fuel injector 9 is acted upon by boosted pressure—in accordance with the boosting ratio of the pressure booster 2. The high-pressure line 8 merges with a nozzle chamber inlet 15, by way of which a nozzle chamber 14 is acted upon by fuel. From the high-pressure line 8, a first inlet throttle 12 branches off into a control chamber 11. The control chamber 11 can be pressure-relieved into a first return 19 on the low-pressure side via a first outlet throttle 13 upon actuation of a first switching valve 18. Via the imposition of pressure and the pressure relief of the control chamber 10, the reciprocating motion of an injection valve member 10, embodied for instance in the form of a needle, is controlled. The injection valve member 10 includes a pressure shoulder 17 in the region of the nozzle chamber 14. The injection valve member 10 is furthermore urged in the closing direction via a spring element 20. The spring element 20 is disposed in a chamber of the body of the fuel injector 9, from which a second return 21 branches off toward the low-pressure side. Upon opening of the injection valve member 10, the injection openings 16, discharging into a combustion chamber, not further shown, of an internal combustion engine are uncovered, so that fuel at high pressure can be injected into the combustion chamber of the engine.

A control chamber 29 of a servo valve 23 is also supplied with fuel at high pressure from the high-pressure source 1, via a supply line 22. The servo valve 23 can be actuated by triggering of a switching valve 24, which on its outlet side discharges into a third return 25 on the low-pressure side. Between the second switching valve 24 and the control chamber 29 of the servo valve 23, a second outlet throttle 27 may be connected. A stop 30 for a face end 28 of a second servo valve piston 33 is also received in the control chamber 29. In the exemplary embodiment of a servo valve shown in FIG. 1, a first piston 32 and a second piston 33 are received in the housing of the servo valve 23. The second piston 33 has a larger diameter, compared to the diameter of the first piston 32. The second piston 33 may be acted upon by a valve spring 31 received in the control chamber 29 of the servo valve 23.

A first hydraulic chamber 34, which has a branch to a fourth low-pressure-side return 35, is located below the second piston 33 in the valve housing of the servo valve 23. A second hydraulic chamber 38 is located below the first hydraulic chamber 34 and is hydraulically in communication with the differential pressure chamber 5 of the pressure booster 2 via a connecting line 43. Between the second hydraulic chamber 38 and a third hydraulic chamber 42, the first piston 32 has an asymmetrically embodied portion. This portion is embodied with an overlapping length forming a flow conduit 41 and uncovers a flow cross section from the second hydraulic chamber 38 into the third hydraulic chamber 42. In the upper region of the first piston 32, below the contact face on the lower face end of the second piston 33, the first piston has a first overlapping length 37 ($h_1$). In the region of the first hydraulic chamber 34, the difference in diameter between the second piston 33 and the first piston 32 forms a pressure shoulder, which is located above a first sealing seat 36. Toward the valve housing, in the lower region of the first piston 32, a sealing edge 40 is embodied as a slide seat. The hydraulic chamber 42 is acted upon by fuel at high pressure via an overflow line 39, which branches off from the supply line 22 for filling the control chamber 29 of the servo valve 23. The face end of the first piston 32 surrounded by the third hydraulic chamber 42 is identified by reference numeral 44.

Figure 2:
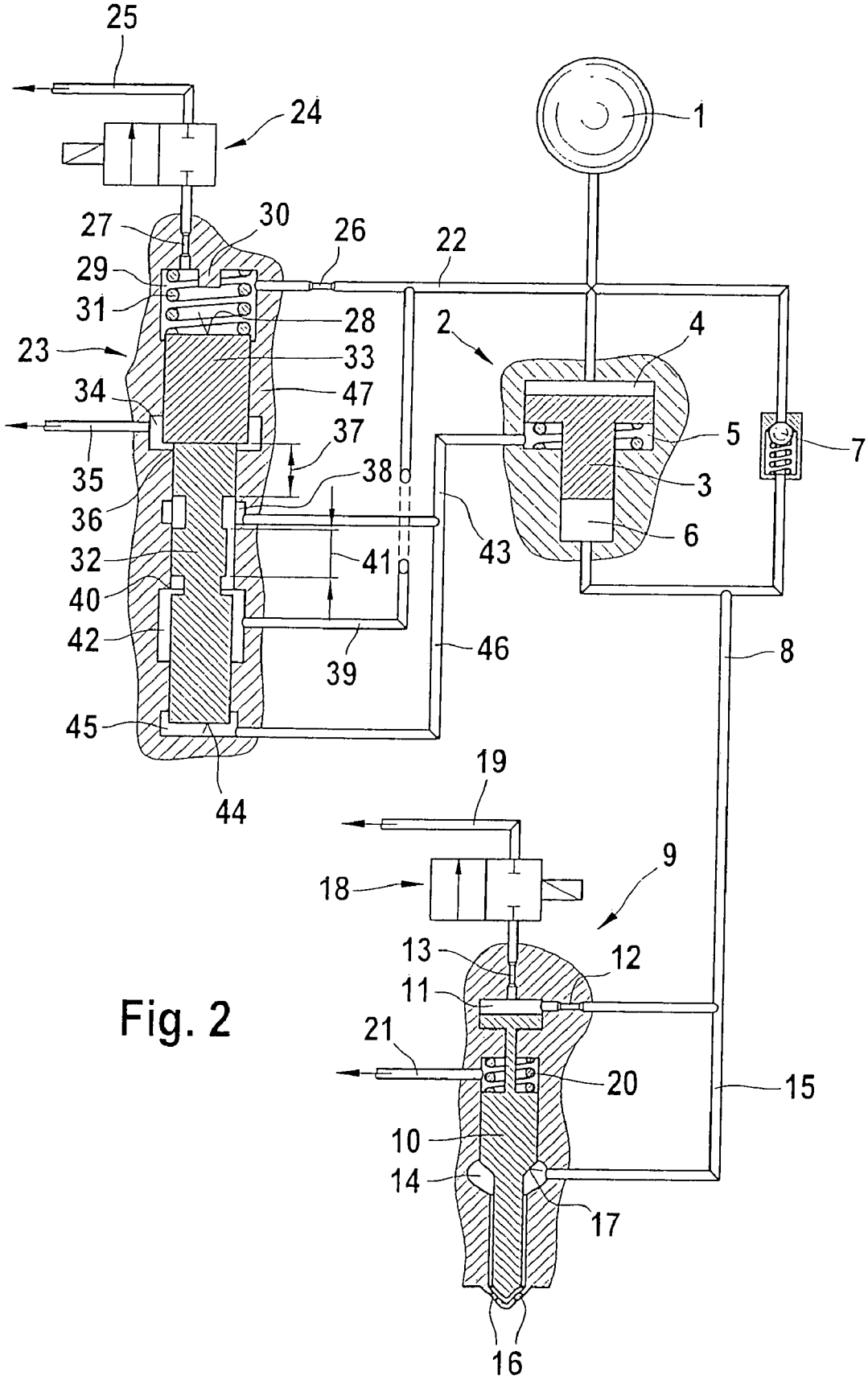
FIG. 2 is a second embodiment of the servo valve shown in FIG. 1, embodied as a slide valve, with a further hydraulic chamber acted upon via the differential pressure chamber.

FIG. 2 shows a modification of the fuel injection system shown in FIG. 1, including a pressure booster and a fuel injector. In a distinction from what FIG. 1 shows, a connecting line portion 46 branches off from the connecting line 43 of the differential pressure chamber 5 of the pressure booster 2 for acting on the second hydraulic chamber 38. The connecting line portion 46 subjects a fourth hydraulic chamber 45 to fuel, which is at the pressure that prevails in the differential pressure chamber 5 of the pressure booster 2. In comparison to the embodiment of the first piston 32 in the variant embodiment shown in FIG. 1, the first piston 32 here is embodied with an extended length that penetrates the third hydraulic chamber 42. The face end 44 of the first piston 32 protrudes into the fourth hydraulic chamber 45 shown in FIG. 2. Accordingly, the face end 44 of the first piston 32 can be acted upon, in the fourth hydraulic chamber 45, by the pressure that prevails in the differential pressure chamber 5.

Otherwise, the variant embodiment shown in FIG. 2 of a fuel injector with a pressure booster that is triggered by a servo valve is equivalent to the variant embodiment already described in conjunction with FIG. 1.

The mode of operation of the fuel injection system shown in FIGS. 1 and 2 with a pressure booster is as follows:

In the outset state, that is, with the second switching valve 24 closed, the control chamber 29 of the servo valve 23 is acted upon via the supply line 22 with the pressure that prevails in the high-pressure source 1 (high-pressure reservoir). Acting on the end face 28 of the second piston 33 is a closing pressure force that is higher than the pressure force acting in the opening direction from the third hydraulic chamber 42 on the face end 44 of the first piston 32. The piston combination 32, 33 is thereby moved into its lower position, so that the first sealing seat 36 is closed, and the second sealing seat 40 is opened because of the open slide edge. As a result, the differential pressure chamber 5 of the pressure booster 2 is acted upon via the second hydraulic chamber 38 via the connecting line 43 and the open flow conduit 41, with the pressure prevailing in the third hydraulic chamber 42, which corresponds to the pressure prevailing in the high-pressure source 1. As a result, the pressure booster 2 remains deactivated, since the pressure prevailing in the high-pressure source 1 also prevails in its work chamber 4. To assure the tightness against high pressure, a first overlapping length 37 is embodied below the pressure shoulder.

By activation of the second switching valve 24, the control chamber 29 of the servo valve 23 is relieved into the third low-pressure-side return 25, and as a result, the piston combination 32, 33 opens. By means of the hydraulic opening force generated in the third hydraulic chamber 42 at the face end 44 of the first piston 32, fast and exact opening of the piston combination 32, 33 is achieved. In the open state, the second sealing seat 40 is closed, while conversely the first sealing seat 36 is open. In this case, the differential pressure chamber 5 of the pressure booster 2 communicates, via the second hydraulic chamber 38, the open first sealing seat 36, and the first hydraulic chamber 34, with the fourth low-pressure-side return 35 branching off from this last chamber, so that the pressure booster 2 is activated, and fuel compressed in its compression chamber 6 flows via the high-pressure line 8 to the control chamber 11 of the fuel injector 9 and to its nozzle chamber 14.

If the second switching valve 24 is closed again, the piston combination 32, 33 moves into its outset position, because of the hydraulic pressure force, operative in the closing direction, in the control chamber 29 of the servo valve 23 that acts on the end face 28 of the second piston 33. Because of the hydraulic closing force, an exactly defined closing motion over the entire stroke course of the piston combination 32, 33 is established. To reinforce the closing motion, a spring force may additionally be provided, for example by spring 31 in the variant embodiments of the servo valve 23 in FIGS. 1 and 2.

To stabilize the guidance of the piston combination 32, 33, an integrated flow path defined by the asymmetrical portion embodied on the first piston 32 over the overlap length 41. Instead of the 3/2-way variant of the servo valve 23 shown in FIGS. 1 and 2, a 2/2-way variant may be employed, or a 4/2-way variant, in which the function of the check valve 7 can be integrated with the piston combination 32, 33 of the servo valve 23.

In a slight modification of the variant embodiment shown in FIG. 1, in the variant embodiment shown in FIG. 2 the fourth hydraulic chamber 45 is provided, in which the pressure force acting in the opening direction on the face end 44 of the first piston 32 prevails. The fourth hydraulic chamber 45 communicates with the differential pressure chamber 5 of the pressure booster 2 via the connecting line 46. In this variant embodiment, the first phase of the closing motion of the piston combination 32, 33 can be speeded up.

Figure 3:
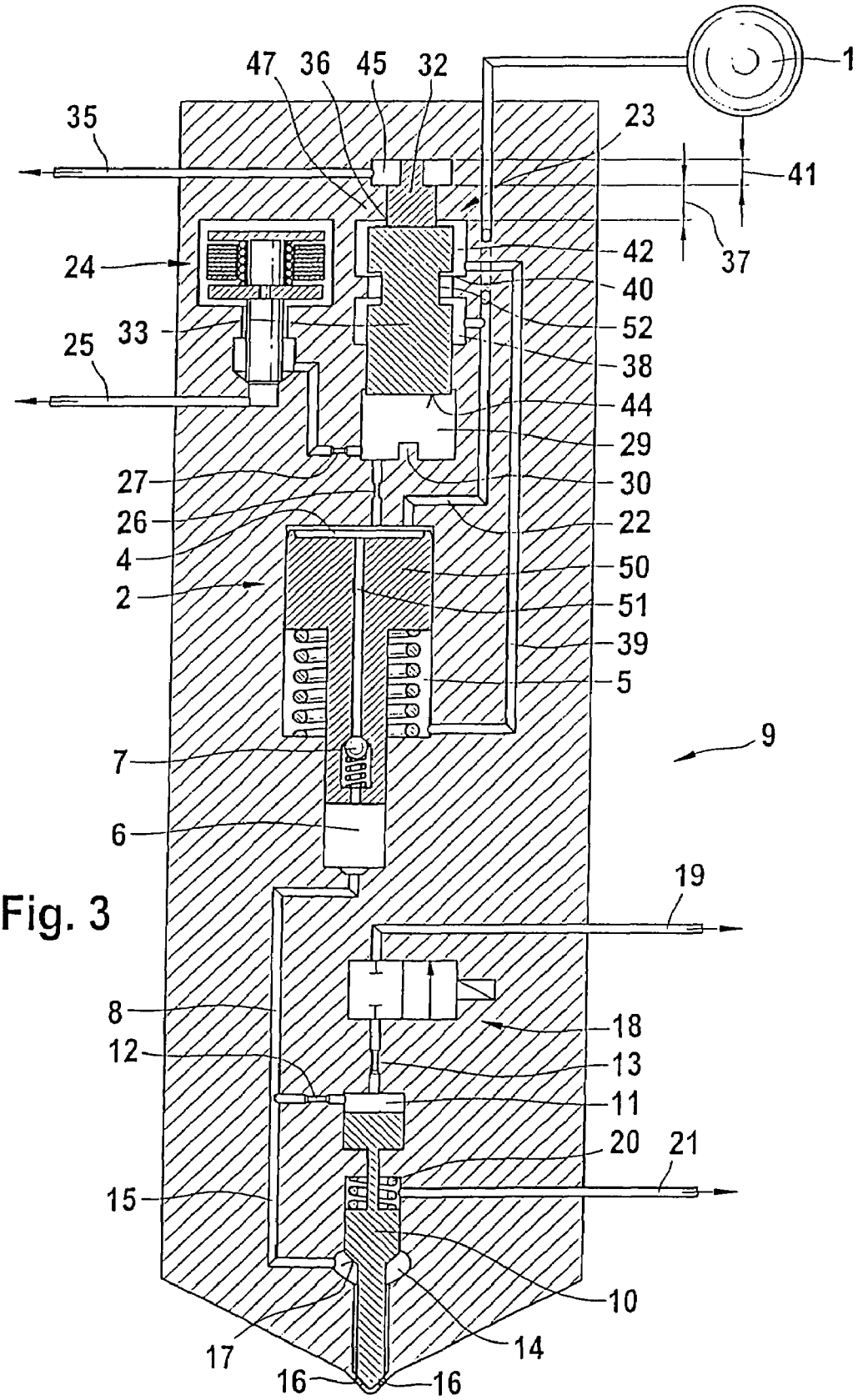
FIG. 3 a further embodiment of a servo valve, embodied as a slide valve, for triggering a pressure booster, shown in the state of repose.

FIG. 3 shows a variant embodiment of a fuel injector in which the pressure booster assigned to this fuel injector is also triggered via a servo valve. In a departure from the booster piston 3 of the pressure booster 2 used in the variant embodiments of FIGS. 1 and 2, in the variant embodiment of FIG. 3 a booster piston 50 with an integrated check valve is provided. Moreover, the subjection of the control chamber 29 of the servo valve 23 to pressure is effected via a second inlet throttle 26 that connects the work chamber 4 of the pressure booster 2 directly with the control chamber 29. This second inlet throttle is not integrated with the supply line 22 by way of which the work chamber 4 of the pressure booster 2 as shown in FIG. 3 is acted upon by the high-pressure source 1 (high-pressure reservoir).

The fuel injector 9 of FIG. 3 is equivalent to the fuel injector that has already been described in conjunction with FIGS. 1 and 2.

The servo valve 23 of FIG. 3 is embodied as a servo-hydraulically supported valve and includes a first valve piston portion 32, with which a smaller-diameter second piston portion part 33 is associated. The valve piston is embodied in one piece. The servo valve 23 is activated and deactivated by actuation of the second switching valve 24. A third low-pressure-side return 25 is associated with the second switching valve 24, and by way of it the control chamber 29 of the servo valve 23 can be pressure-relieved into the third low-pressure-side return 25, with the interposition of the second outlet throttle 27.

The booster piston 50 of the pressure booster 2 in the variant embodiment of FIG. 3 includes a through conduit 51, which connects the work chamber 4 with the compression chamber 6 of the pressure booster 2. Via the check valve 7 integrated with the booster piston 50, refilling of the compression chamber 6 is effected via the work chamber 4.

In a departure from the variant embodiments shown in FIGS. 1 and 2 in terms of the first hydraulic chamber 34 on the servo valve 23, in the variant embodiment of FIG. 3 this hydraulic chamber is embodied not in the valve housing 47 of the servo valve 23 but rather on the piston in the form of a constriction 52.

FIG. 3 shows the switching position of the servo valve 23 in which the pressure booster 2 is deactivated. In the control chamber 29, with the second switching valve 24 placed in its seat, the pressure level prevailing in the high-pressure source 1 (high-pressure reservoir) also prevails, via the second inlet throttle 26 branching off from the work chamber 4 and via the supply line 22. As a result of the pressure force engaging the end face 44 of the first valve piston part 32, this valve piston part is pressed into its upper position, since the closing force acting on the face end 44 is greater than the pressure force acting in the opening direction that engages the annularly extending pressure shoulder in the third hydraulic chamber 42. In this position of the first valve piston part 32, because of the overlapping length 37, the first sealing seat 36 is closed, while conversely the second sealing seat 40 in the housing 47 of the servo valve 23 is open. Because of this, the differential pressure chamber 5 of the pressure booster 2 is subjected, via the open second sealing seat 40 and the second hydraulic chamber 38, to the pressure prevailing in the third hydraulic chamber 42, and the pressure booster 2 therefore remains deactivated.

To assure adequate high-pressure tightness of the third hydraulic chamber 42 relative to the fourth hydraulic chamber 45 on the low-pressure side and the fourth low-pressure-side return 35 branching off from it, the first overlapping length 37 is embodied on the second valve piston part 33. Because of the second valve piston part 33, the first overlapping length 37 is markedly reduced in the variant embodiment of FIG. 3, compared to the first overlapping length 37 in the variant embodiments of FIGS. 1 and 2.

Figure 4:
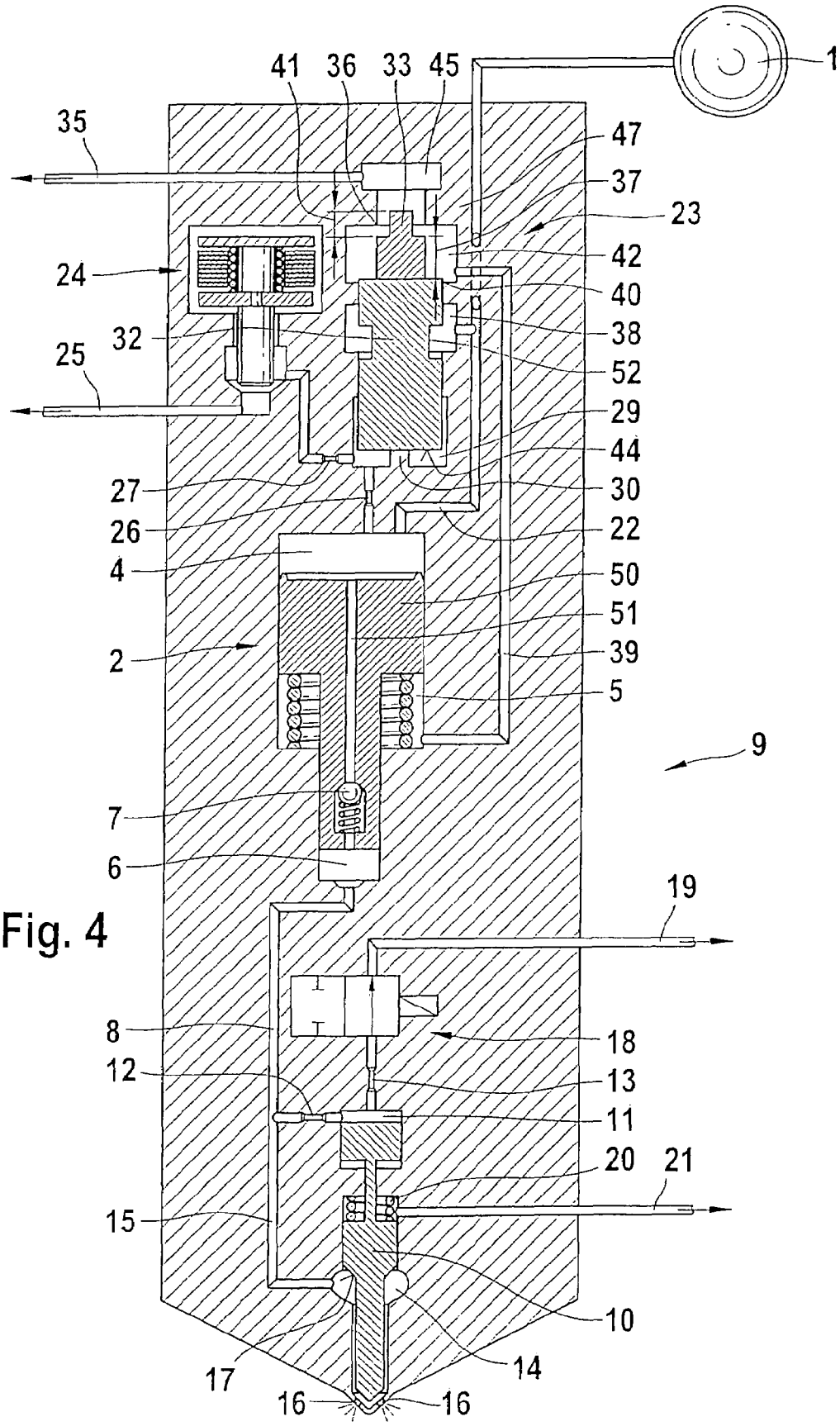
FIG. 4 the embodiment shown in FIG. 3 of a servo valve embodied as a slide valve, with the pressure booster activated.

FIG. 4 shows the activated state of the switching valve of FIG. 3 that triggers the pressure booster of a fuel injector.

Beginning in the outset state shown in FIG. 3, upon activation of the first switching valve 24 in FIG. 4, the control chamber 29 of the servo valve 23 is relieved via the second outlet throttle 27 into the third low-pressure-side return 25. The piston 32, because of the decreasing pressure in the control chamber 29, moves with its end face 44 against a stop 30. The opening motion of the first valve piston part 32 and the second valve piston part 33 is reinforced by the hydraulic opening force generated in the third hydraulic chamber 42. This hydraulic chamber communicates via the overflow line 39 with the differential pressure chamber 5 of the pressure booster 2, from which upon a pressure relief a not inconsiderable control volume flows out, via the third hydraulic chamber 42 and the fourth hydraulic chamber 45, into the fourth low-pressure-side return 35. In the deactivated state of the servo valve 23 as shown in FIG. 4, the second sealing seat 40 is closed, while conversely the first sealing seat 36 is open, because of the first overlapping length 37 that has moved out of the housing 47 of the servo valve 23. The differential pressure chamber 5 of the pressure booster 2 now communicates via the third hydraulic chamber 42 and the open first sealing seat 36 via the fourth hydraulic chamber 45 with the fourth low-pressure-side return 35, so that the booster piston 50 with the integrated check valve 7 moves into the compression chamber 6 of the pressure booster 2. As a result, both the control chamber 11 of the fuel injector 9 and, via the nozzle chamber inlet 15, the nozzle chamber 14 of the fuel injector 9 are acted upon by fuel that is at elevated pressure.

Upon another actuation of the second switching valve 24, that is, upon closure of the third low-pressure-side return 25, pressure builds up in the control chamber 29 of the servo valve 23, so that the first valve piston part 32 and the second valve piston part 33 move back into the outset position shown in FIG. 3. By means of a hydraulic closing force generated in this way, a fast, exactly defined closing motion over the entire stroke course of the valve piston with the first valve piston part 32 and the second valve piston part 33 is attained in the servo valve 23. To reinforce the closing motion, spring elements may be provided in the control chamber 29 of the servo valve 23.

Analogously to the embodiment of the second pistons 32 in the variant embodiments of FIGS. 1 and 2, integrated flow conduits 41 may be provided on the second valve piston part 33 of the valve piston as shown in FIGS. 3 and 4; these flow conduits serve to stabilize the piston motion in the servo valve 23.

Figure 5:
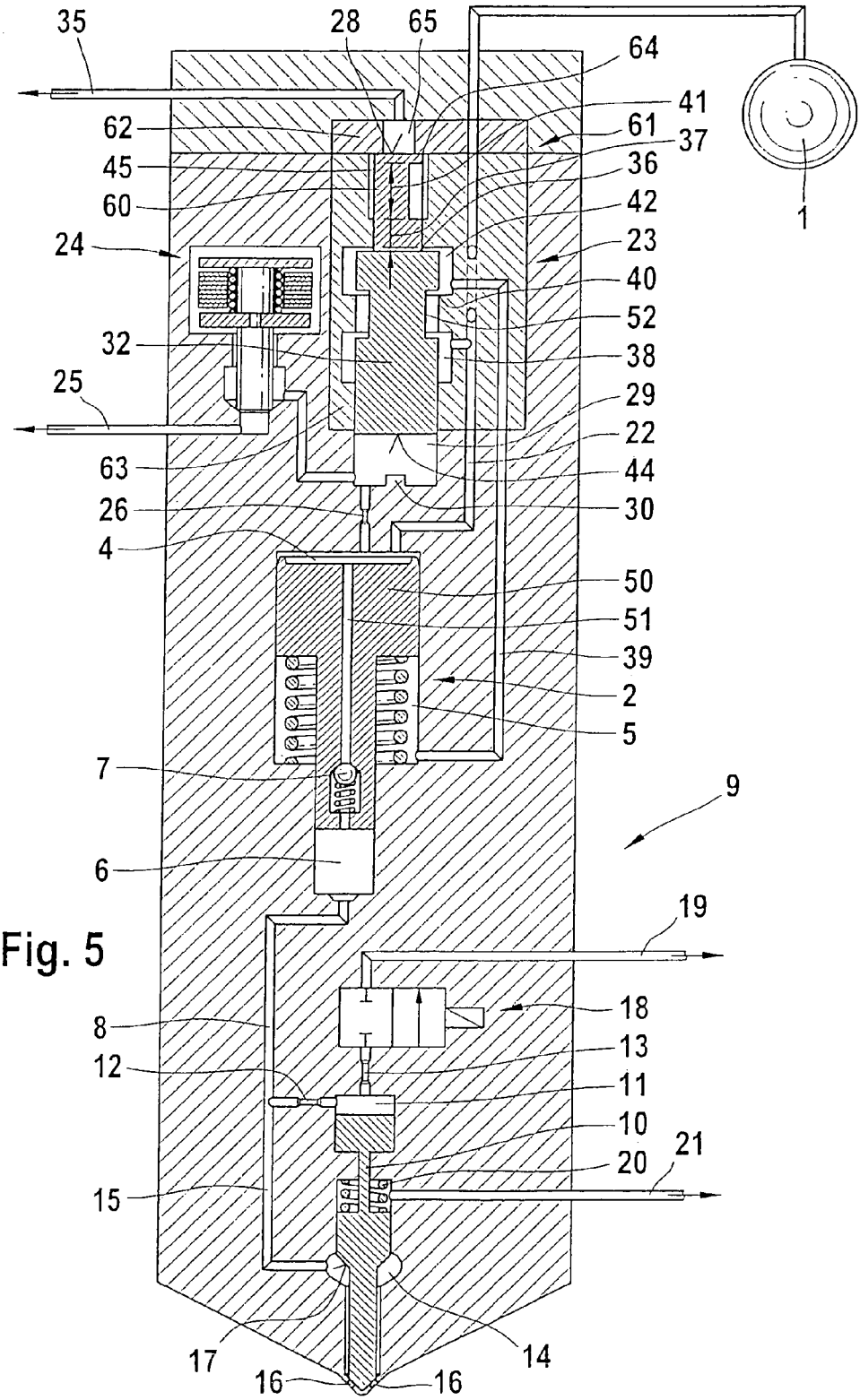
FIG. 5 is a further embodiment of a servo valve embodied as a slide valve, with a multi-part servo valve housing and a flat seat embodied in it, in the state of repose.

FIG. 5 shows a further variant embodiment of a servo valve that triggers a pressure booster of a fuel injector.

The variant embodiment of the servo valve 23 shown in FIG. 5 is in its outset state, that is, its closed position. The pressure booster 2 shown in the variant embodiment of FIG. 5 is equivalent to the version of the pressure booster in FIGS. 3 and 4 with an integrated check valve 7. The fuel injector 9 is embodied analogously to the fuel injectors already described in conjunction with FIGS. 1, 2, 3, and 4.

In the departure from the variant embodiments shown thus far of the servo valve 23 the servo valve 23 of FIG. 5 includes a multi-part housing 61, including a first housing part 62, from which the fourth low-pressure-side return 35 branches off, and a second housing part 63, which receives the one-piece valve piston 60 of the servo valve 23. The valve piston 60 includes a first valve piston part 32 and a reduced-diameter valve piston part (unnumbered). Diametrically opposite the end face 28 of the reduced-diameter valve piston part, a further seal 64 is embodied on the underside of the first housing part 62 of the multi-part housing 61. The seal 64 may be embodied as a flat seat, conical seat, or ball seat. One or more flow conduits 41 are disposed on the circumference of the reduced-diameter valve piston part. The overlapping length 37 on the outer circumference of the reduced-diameter part of valve piston 60 is further reduced, in comparison to the overlapping lengths 37 of the second valve piston part 33 as shown in FIGS. 3 and 4.

In the outset state shown in FIG. 5, that is, in this switching position of the servo valve 23, the pressure level prevailing in the high-pressure source prevails in the control chamber 29 of the servo valve 23, via the second inlet throttle 26, the work chamber 4 of the pressure booster 2, and the supply line 22 that branches off from the high-pressure source (high-pressure reservoir). The second switching valve 24 closes the third low-pressure-side return 25. Because of the pressure prevailing in the control chamber 29, a pressure force acting in the closing direction acts on the face end 44 of the first valve piston part 32. This pressure is greater than the pressure force operative in the opening direction that acts on the annular face in the third hydraulic chamber 42 on the first valve piston part 32, so that the first valve piston part 32 is put into the position shown in FIG. 5, seating the seal 64. In this position of the valve piston 60 of the servo valve 23, the first sealing seat 36 is closed, while conversely the second sealing seat 40, embodied as a slide seal, is open. Because of the sealing of the fourth hydraulic chamber 45 by the closed seal 64, when the servo valve 23 is closed no leakage flow into the fourth low-pressure-side return 35 arises. As a result, lesser demands of the reference leakage can be allowed with respect to the guide length and the acceptable play at the first overlapping length 37.

The seal 64 can be embodied in manifold ways that can be represented as a flat seat, conical seat or ball seat. Embodying the seal 64 as a flat seat in conjunction with a multi-part housing 61 of the servo valve 23 is particularly advantageous. If the seal 64 is embodied in particular as a flat seat in a separate housing part 62, then any axial offset that may occur between the valve piston 60 of the servo valve 23 and the housing part 62 can be compensated for. With the structural form of the servo valve 23 as shown in FIG. 5, a strong closing force, which improves the sealing action, is brought to bear on the valve piston 60 of the servo valve 23, and as a result, when the seal 64 is embodied as a flat seat, for example, a very high pressure per unit of surface area and hence a good sealing action are established.

In the state of repose of the servo valve 23 as shown in FIG. 5, the differential pressure chamber 5 of the pressure booster 2 is in communication, via the open sealing edge 40 and the second hydraulic chamber 38 embodied in the second housing part 63, with the interposition of the third hydraulic chamber 42, with the pressure prevailing in the high-pressure source 1 (high-pressure reservoir). The pressure booster 2 is thus deactivated, since the same pressure prevails in both the work chamber 4 and the differential pressure chamber 5.

Upon activation of the second switching valve 24, the control chamber 29 of the servo valve 23 is pressure-relieved.

Figure 6:
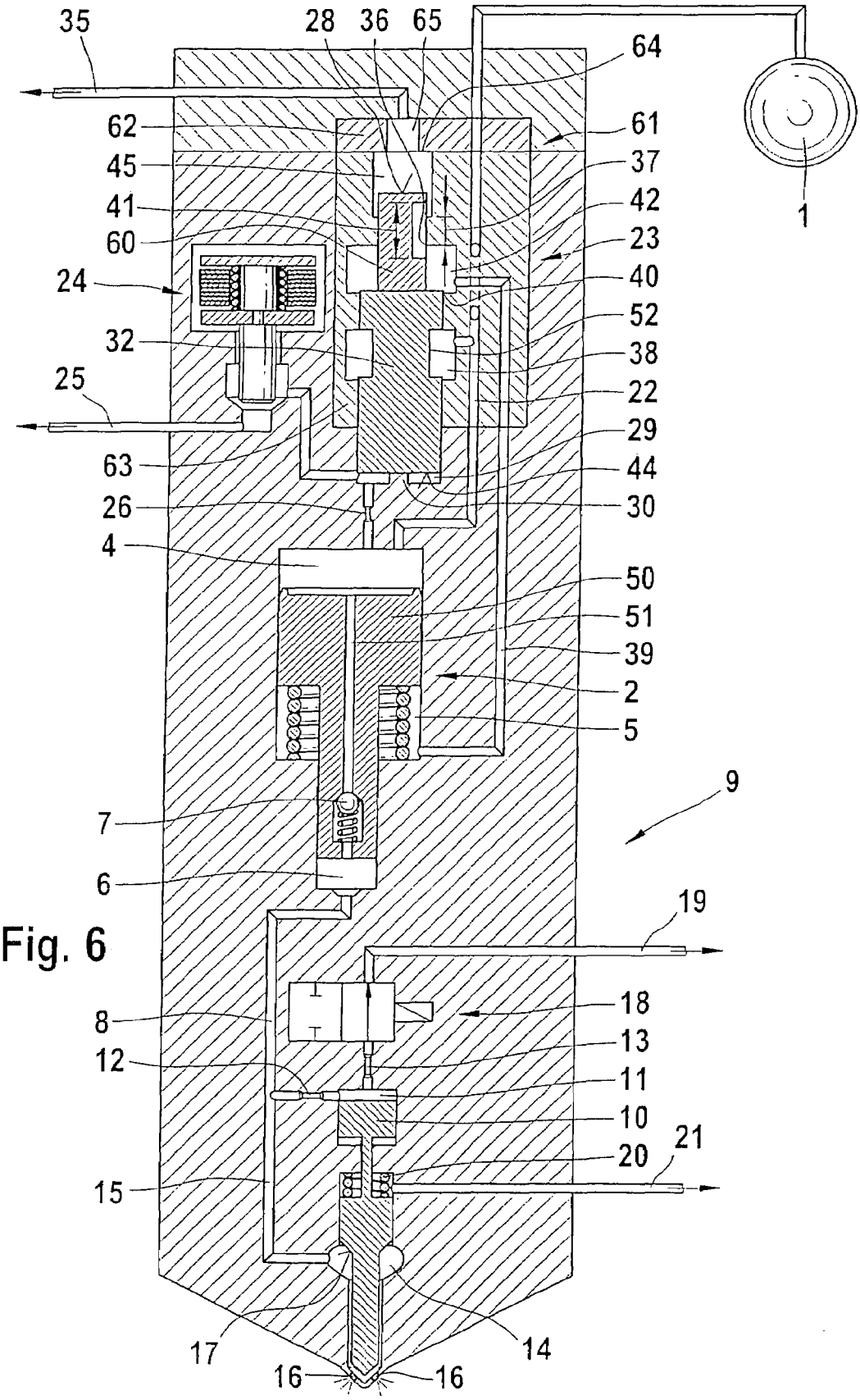
FIG. 6 the embodiment shown in FIG. 5 of a servo valve embodied as a slide valve, with the pressure booster activated.

FIG. 6 shows the servo valve of the variant embodiment of FIG. 5, upon actuation by the second switching valve 24.

In response to a pressure relief of the control chamber 29 of the servo valve 23, fuel flows via the second switching valve 24 into the third low-pressure-side return 25. The valve piston 60 of the servo valve 23 moves toward a stop 30 embodied in the control chamber 29 of the servo valve 23. The face end 44 of the valve piston 60 rests on this stop 30, as shown in FIG. 6. Fast, exact opening is attained as a result of the hydraulic force generated in the third hydraulic chamber 42 because of the control volume flowing over from the differential pressure chamber 5 via the overflow line 39. In the opening motion of the valve piston 60, first the seal 64 is opened and the sealing edge 40 is closed. Only after that does opening of the first sealing 36, embodied as a slide seal, take place. As a result, a short-circuited leakage flow from the second hydraulic chamber 38 into the fourth low-pressure-side return 35 can be prevented from occurring. Now, the differential pressure chamber 5 of the pressure booster 2 communicates with the fourth low-pressure-side return 35, via the third hydraulic chamber 42, the open slide seal 36, the open seal 64, and a further hydraulic chamber 65 embodied in the first housing part 62. The pressure booster 2 is thus activated and compresses the fuel volume contained in the compression chamber 6.

Upon another actuation of the second switching valve 24 and an attendant refilling of the control chamber 29 of the servo valve 23, the valve piston 60 of the servo valve 23 moves into its outset position as shown in FIG. 5 as a result of the hydraulic pressure force that builds up in the control chamber 29. Because of the buildup of hydraulic closing force in the control chamber 29 of the servo valve 23, an exactly effected defined closing motion over the entire stroke range of the valve piston 60 is assured. To reinforce the closing motion, spring elements additionally integrated with the control chamber 29 can be employed, but they are not shown further in FIGS. 5 and 6. Upon closure of the servo valve 23, a closure of the first sealing seat (or slide seal 36) takes place first. By the closure of the slide seal 36, the differential pressure chamber 5 of the pressure booster 2 is decoupled from the fourth low-pressure-side return 35. Not until a further closing stroke of the valve piston 60 and hence after a delay period $t_1$ does the opening of the sealing edge 40 occur, so that only then is the pressure booster 2 fully deactivated. Upon a further stroke of the valve piston 60 in the direction of the seal 64, its closure occurs. As a result of the delay period $t_1$, after a main injection has been performed, a pressure cushion is still maintained for a brief period in the nozzle chamber 14 of the fuel injector and can be utilized for a post injection at high pressure. Because of this switching sequence of opening and closing of the sealing points 36, 40, 64, an overlap in opening cross sections can be avoided; that is, during the motion of the valve piston, no phase with the simultaneous opening of two flow cross sections occurs.

The reduced-diameter part of the valve piston 60 as shown in FIGS. 5 and 6 includes one or more integrated flow conduits 41, for stabilizing the piston motion in the guide region. The returns 19, 21, 25, 35 may, instead of the returns embodied separately from one another in FIGS. 1 through 6, also be embodied as partially or completely combined and connected to a return system that is common to all the returns.

The foregoing relates to a preferred exemplary embodiment of the invention, it being understood that other variants and embodiments thereof are possible within the spirit and scope of the invention, the latter being defined by the appended claims.

The invention claimed is:

1. A servo valve for actuating a pressure booster which is assigned to a fuel injector, the pressure booster having a work chamber which is separated by a booster piston from a differential pressure chamber, and the pressure change in the differential pressure chamber of the pressure booster is effected via the servo valve, to which a switching valve activating it is assigned, the servo valve comprising:

a valve housing a control chamber which communicates with a high-pressure source and is selectively pressure-relieved into a low-pressure-side return, and a pressure shoulder acting in the closing direction of a valve piston is located between the control chamber and a hydraulic chamber, and control edges without a common opening phase are embodied on the valve piston for generating a fast closing motion at the valve piston.

2. The servo valve according to claim 1, wherein the valve piston comprises both a first valve piston part and a reduced-diameter second valve piston part.

3. The servo valve according to claim 2, wherein an overlapping length that forms a slide seal is embodied on the reduced-diameter valve piston part.

4. The servo valve according to claim 2, further comprising one or more flow conduits are embodied on the reduced-diameter valve piston part of the valve piston.

5. The servo valve according to claim 2, wherein the dividing point between the first valve piston part and the reduced-diameter second valve piston part is located in a low-pressure-side chamber, and face ends of the valve piston parts are acted upon by high pressure.

6. The servo valve according to claim 1, further comprising a guide portion in the servo valve housing that originates at the control chamber, the guide portion discharging into a second hydraulic chamber acted upon by high pressure.

7. The servo valve according to claim 6, wherein the guide portion of the first valve piston part is embodied without valve pockets in the servo valve housing.

8. The servo valve according to claim 6, further comprising a further seal embodied on the valve piston and cooperating with a housing part of a multi-part valve housing.

9. The servo valve according to claim 8, wherein the further seal is embodied as a flat seat.

10. The servo valve according to claim 6, further comprising integrated flow conduits that enable an outflow of fuel embodied on the valve piston above an overlapping length with a second housing part of the multi-part housing.

11. The servo valve according to claim 1, wherein a pressure face that is operative in the opening direction of the servo valve piston is acted upon by the pressure prevailing in the differential pressure chamber.

12. The servo valve according to claim 1, wherein when the servo valve is deactivated, the low-pressure side is sealed off from the high-pressure side by a guide portion of the valve piston.

* * * * *